US005592836A

United States Patent [19]

Schuster et al.

[11] Patent Number: 5,592,836

[45] Date of Patent: Jan. 14, 1997

[54] CIRCULARLY KNIT BRASSIERE HAVING KNIT-IN-LIFT AND SUPPORT PANELS, AND A BLANK AND METHOD FOR MAKING SAME

[75] Inventors: Thomas F. Schuster, Hickory; Harold G. Osborne, Boomer, both of N.C.

[73] Assignee: Alba-Waldensian, Inc., Valdese, N.C.

[21] Appl. No.: 479,180

[22] Filed: Jun. 7, 1995

Related U.S. Application Data

[63] Continuation-in-part of Ser. No. 237,114, May 3, 1994, Pat. No. 5,479,791, and a continuation-in-part of Ser. No. 382, 864, Feb. 3, 1995.

[51] Int. Cl.[6] ..... A41B 9/06; A41C 1/00

[52] U.S. Cl. ..... 66/176; 66/171; 450/156

[58] Field of Search ..... 66/171, 176, 177, 66/153; 450/156

[56] References Cited

U.S. PATENT DOCUMENTS

| | | | |
|---|---|---|---|
| 993,112 | 5/1911 | Scott | 66/199 |
| 993,799 | 5/1911 | Scott | 66/199 |
| 1,775,033 | 9/1930 | Wilkinson | 66/153 X |
| 2,174,948 | 10/1939 | Raven et al. | 66/153 |
| 2,293,639 | 8/1942 | Coleman | 66/188 |
| 2,668,953 | 2/1954 | Tofanelli | 2/28 |
| 2,928,397 | 3/1960 | Pucci | 128/523 |
| 2,980,114 | 4/1961 | Montoya | 128/523 |
| 3,131,698 | 5/1964 | Morano | 128/523 |
| 3,224,231 | 12/1965 | Matz | 66/171 |
| 3,375,829 | 4/1968 | Brennan et al. | 128/539 |
| 3,376,717 | 4/1968 | Scheller et al. | 66/199 |
| 3,413,824 | 12/1968 | Kuney | 66/177 |
| 3,421,513 | 1/1969 | Landau | 128/443 |
| 3,425,246 | 2/1969 | Knohl | 66/176 X |
| 3,537,279 | 11/1970 | Epley | 6/176 |
| 3,999,406 | 12/1976 | Boeckle et al. | 66/177 |
| 4,325,379 | 4/1982 | Ozbey | 128/540 |
| 4,341,219 | 7/1982 | Kuznetz | 128/498 |
| 4,390,999 | 7/1983 | Lawson et al. | 2/409 |
| 4,531,525 | 7/1985 | Richards | 128/489 |
| 4,548,057 | 10/1985 | Essig | 66/172 R |
| 4,624,115 | 11/1986 | Safrit et al. | 66/172 R |
| 4,682,479 | 7/1987 | Pernick | 66/176 |
| 5,081,854 | 1/1992 | Lonati | 66/176 |
| 5,479,791 | 1/1996 | Osborne | 66/171 |

FOREIGN PATENT DOCUMENTS

| | | |
|---|---|---|
| 0387766 | 9/1990 | European Pat. Off. . |
| 2220150 | 9/1974 | France . |

*Primary Examiner*—John J. Calvert
*Attorney, Agent, or Firm*—Bell, Seltzer, Park & Gibson, P.A.

[57] ABSTRACT

This invention discloses a circularly knit brassiere having integrally knit-in support panels and cup fullness. The brassiere is knit on a circular knitting machine, and the support panels have a modified knit structure to provide them with a greater resistance to stretching, particularly in the coursewise direction. The support panels are separated by differentially-shaped breast cups, which can be formed by way of the feeding-in of an additional yarn or yarns to form additional courses in the cup area, or through the provision of a gathered center panel. The entire brassiere is produced in the form of a tubular blank, and portions are cut and removed to define shoulder straps and a neck opening. The straps are seamed together to form a completed brassiere having only a minimal number of seams, and banding or the like may be provided on the arm and neck openings.

28 Claims, 1 Drawing Sheet

CIRCULARLY KNIT BRASSIERE HAVING KNIT-IN-LIFT AND SUPPORT PANELS, AND A BLANK AND METHOD FOR MAKING SAME

RELATED APPLICATIONS

This application in a Continuation-in-Part of copending U.S. patent applications Ser. Nos. 08/237,114, filed May 3, 1994 for "Brassiere Blank, Brassiere and Methods of Making Same" now U.S. Pat. No. 5,479,791, and 08/382,864 for "Panty Having Knit-In Lift and Separation", which was filed in the U.S. Patent Office on Feb. 3, 1995.

BACKGROUND OF THE INVENTION (1) Field of the Invention

The present invention relates to a brassiere, the blank for making the brassiere, and to the methods for making the brassiere and the blank. More particularly, this invention relates to the production of a brassiere blank on a circular knitting machine having integrally knit breast cups and support panels for lifting, shaping, and separating the cups, and the production of such brassieres using only a minimal number of manufacturing steps.

(2) Description of the Prior Art

Brassieres having fabric areas to define breast cups have been produced by full fashioned and reciprocating knitting machines, but their production tends to be slow and inefficient unless circular knitting is used.

One circular knitting process is disclosed in U.S. Pat. No. 4,531,525 to Richards which discloses a brassiere blank made on a circular knitting machine. The process includes producing a tubular blank having a torso portion with a pair of breast cups, straps knit integrally with the torso portion, and turned welt portions at each end of the tubular blank. The tubular blank is slit on one side and laid flat for cutting neck and arm openings and is then seamed at each side to form the brassiere. The breast cup fullness of the brassiere is provided by way of a gathered panels located between the cups and along the brassiere side panels. The cup fullness provided by this method, however, is necessarily limited and may not provide enough fullness for fuller figured women. Further, due to the ability of knitted fabrics (such that used in the Richards patent) to stretch, such brassieres may fail to provide an adequate level of support for larger chested wearers.

Attempts have been made on nether-type knitted undergarments to provide variations in the compression provided by the undergarment in areas corresponding to particular areas of a wearer's body. For example, U.S. Pat. No. 4,390,999 to Lawson et al. describes the provision of a fabric portion having a medium amount of compressive force between a highly compressive upper waist or leg portion and a low compression body portion, in order to ease the transition from the highly compressive portion to the low compression portion and reduce the resultant body bulge which can be caused by that transition. The areas providing the medium amount of compressive force are shaped and located so that they extend circumferentially about the waist or leg of the wearer in the manner of a band, and they are formed by changing the yarn used to knit various courses.

Similarly, U.S. Pat. No. 3,413,824 to Kuney discloses knitted garments which include form-fitting pockets in order that they can accentuate specific portions of the body. The garments are knitted using a constant knit structure, with the stitch length being varied in selected areas to form spaced concave areas which are designed to correspond to specific regions of the wearer's body. In the illustrated embodiments, the nether garments include loosely knit regions corresponding to the buttock cheeks and a tightly knit seam piece extending vertically between the loosely knit regions. Though mentioning broudly that the structure could be used with brassieres, the Kuney patent does not disclose how the structure can be used with a brassiere. Further, the stitch structure is not modified; rather the stitch length is adjusted in specific areas.

U.S. Pat. No. 3.425,246 to Knohl discloses a knitted brassiere having extra courses of elastic yarn knitted into the breast cups to shape the cups. Such brassieres, however, would tend to lack sufficient support for larger-chested wearers, as they fail to include supplemental support means.

Thus a need exists for a brassiere which provides an adequate amount of lift and support for the wearer and which may be readily manufactured using only a minimal number of manufacturing steps. In addition, a need exists for a method and blank for making such a brassiere.

SUMMARY OF THE INVENTION

It is an object of the present invention to provide a method of making a circularly knit blank having integrally knit support panels in which may be made into a brassiere using only a minimal number of manufacturing steps.

It is a further object of the invention to provide a blank for manufacturing a brassiere having integrally knit support panels.

An additional object of the invention is to provide a method of making a brassiere using only a minimal number of manufacturing steps and a minimal input of labor.

A further object of this invention is to provide a brassiere which provides a comfortable fit and adequate lift and support for the wearer's breasts.

In accordance with the present invention, there is described a method of manufacturing a circularly knit blank which can be readily transformed into a completed brassiere. The method includes knitting a series of courses in the form of a turned welt and knitting a series of courses to said turned welt to form an upper torso portion which includes at least first and second discrete integrally knit support panels which have a greater resistance to coursewise stretch than the rest of the upper torso portion, and which are separated by first and second differentially shaped breast cups. In a preferred embodiment of the invention, the support panels are substantially C-shaped, and are positioned adjacent the outer sides of the breast cups so that the concave side of each of the substantially C-shaped panels faces inwardly toward the breast cup. In a particularly preferred embodiment of the invention, a second substantially C-shaped support panel is provided parallel to each of the first substantially C-shaped support panels and positioned adjacent thereto.

In order to provide additional fullness to the breast cups, an additional yarn or yarns can be fed in to form additional courses in the breast cup regions. A series of courses defining a shoulder portion is then knit to the upper torso portion, and it is knit to include plural elongated areas in which the courses are simple knit, divided by elongate panel areas in order to form shoulder strap portions. A non-raveling edge is then knit to the shoulder portion to complete the brassiere blank.

The blank according to the present invention thus includes a cylindrical tubular fabric torso encircling portion in the form of a turned welt, an upper torso portion having a pair of differentially-shaped, spaced apart breast cups, and first and second discrete support panels which have a greater resistance to coursewise stretch than the remainder of the upper torso portion. A strap-forming shoulder portion is integrally knit to the upper torso portion and includes plural elongated areas in which the courses are simple knit, each of which is separated from the other by an elongate panel area. The blank also includes a non-raveling edge, in order that it does not ravel during its conversion into a finished brassiere.

The blank can then be easily converted into a completed brassiere by cutting and removing portions of the shoulder and upper torso portions of the blank to define arm openings, shoulder straps and a neck opening, then sewing front and rear portions of the blank together at the shoulder straps. In a preferred embodiment of the invention, banding or the like is sewn around the neck opening and arm openings, to provide a closer fit of these regions and a more appealing finished appearance.

The brassiere of the present invention thus includes first and second breast cups and integrally knit support panels which have a greater resistance to stretch than the remainder of the brassiere. This brassiere provides the comfort of a knitted brassiere, while providing lift and support similar to that of full-fashioned brassieres. In addition, the additional fullness provided in the breast cup area provides greater comfort and a more accurate fit for full-figured wearers.

Though discussed specifically with respect to women's brassieres, it is noted that the invention is not limited to ladies undergarments alone. Rather, men, women and children alike may enjoy the comfort provided by brassieres according to the instant invention. Similarly, the invention is not limited to undergarments, as the invention can be worn as an outer garment such as aerobic fitness apparel and the like.

DESCRIPTION OF THE PREFERRED EMBODIMENTS

Figure 1:
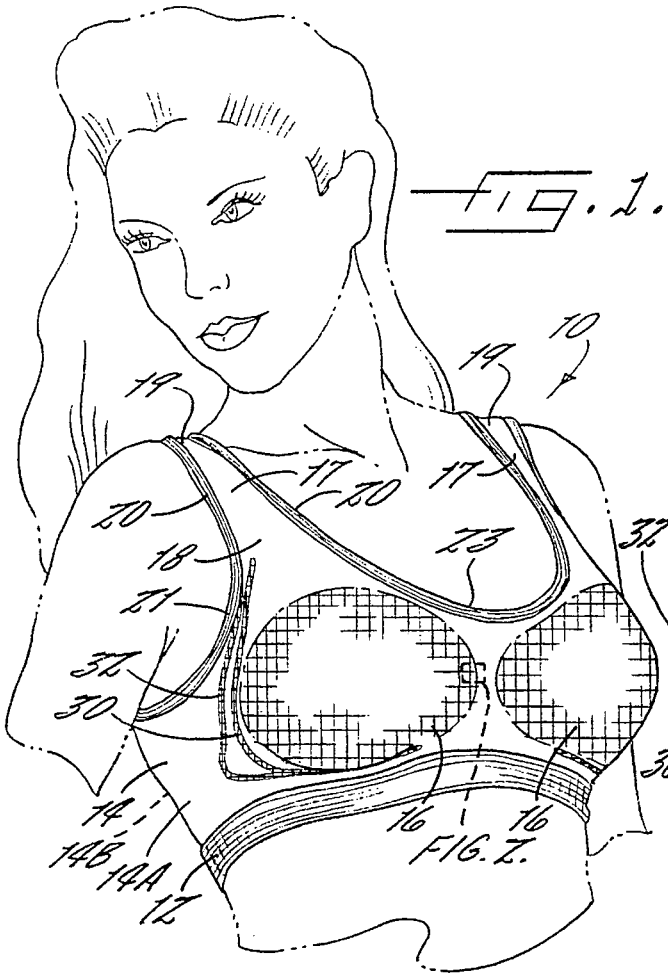
FIG. 1 is a perspective view illustrating an embodiment of a brassiere according the present invention as it appears when worn.

Referring now to the drawings, FIG. 1 shows a preferred embodiment of the present invention in the form of a ladies brassiere 10, as it appears during wear. The brassiere includes a torso encircling portion 12, which is preferably provided as a cylindrical tubular fabric portion in the form of a turned welt. An upper torso portion 14 is knit to the torso encircling portion 12 in the form of a tubular fabric portion. The upper torso portion 14, in its continuously knit tubular form includes, for illustrative purposes of location only, front and rear portions 14A and 14B, respectively, and first and second sides. It is to be noted, however, that the reference to these portions as individual elements is for illustrative purposes only, as they all form part of the integrally knit, tubular upper torso portion 14.

The upper torso portion 14 includes first and second differentially-shaped, integrally knit breast cups 16, which are located in spaced relation with respect to each other on the upper torso portion. In a preferred form of the invention, the breast cups are defined by areas in which the courses are simple knit and have succeeding areas of courses varying between simple knit and welt knit courses. The breast cups 16 can also include a center gathered panel area (not shown) in the manner disclosed in the co-pending related application Ser. No. 08/237,114, discussed above. This gathered portion is made by pulling the cams of a knitting machine away from the butts, allowing the shorter butt needles to pass through underneath the cams to hold the stitch for a predetermined number of courses, say 3 to 20 and preferably 10 to 12. The needles are then raised to clear the stitch to form a pleat, and the process is repeated until the gather is formed. Needles for tuck or pleat can be made without using cams by the selection of the needles to hold the stitch by knitting at welt height. The cams are then returned to the cylinder so that the short butt needles will rise.

Figure 2:
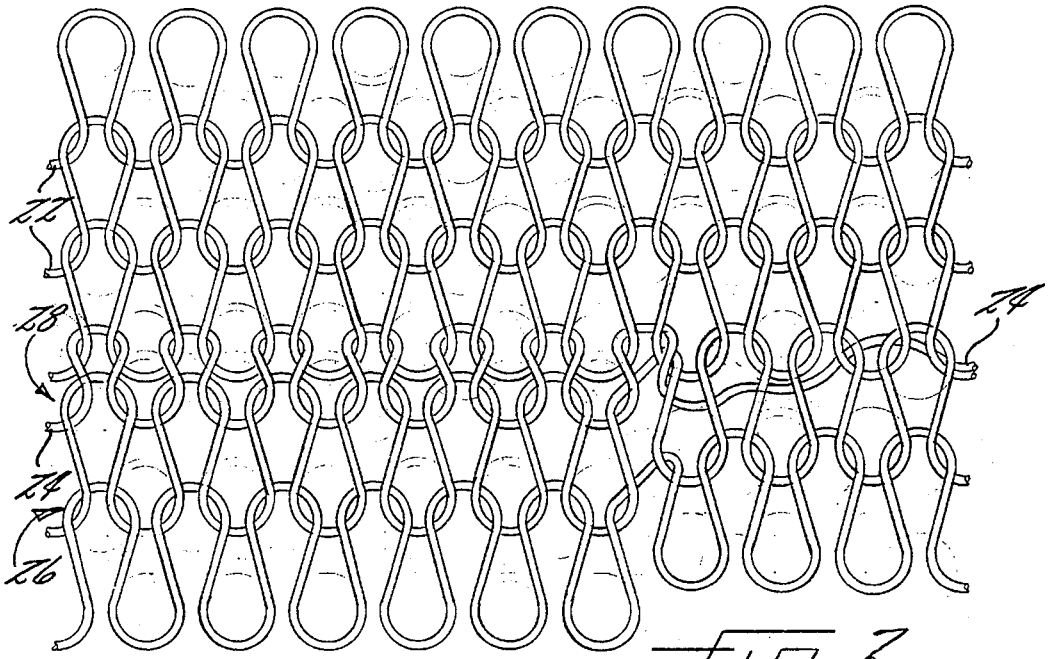
FIG. 2 is an enlarged view of the knit courses shown in the breast cup region of FIG. 1.

In a particularly preferred embodiment of the invention, yarns 22 forming courses 26 which form the upper torso portion 14 have an additional yarn or yarns 24 fed in in the regions of the breast cups 16 in order to form additional courses 28 therein. These additional courses 28, as shown in FIG. 2, provide additional fabric in the breast cups 16, thereby providing knit-in cup fullness. In this way, the number of yarns 24 fed in can be selected by the manufacturer to achieve the desired cup fullness.

The upper torso portion 14 also includes integrally knit discrete support panels which have a modified knit structure having a greater resistance to stretching, particularly in the coursewise direction, from that of the rest of the upper toro portion. These support panels provide lift and support for the wearer's breasts. The support panels can assume a variety of configurations and positions, so long as they provide lift and support to the wearer. A preferred construction of the support panels is as first and second substantially C-shaped panels 30 located adjacent outer sides of the breast cups 16 (i.e. the side of the cup nearest the wearer's arm), which are positioned so that the concave side of each of the panels faces inwardly toward the breast cups. In a particularly preferred embodiment of the invention, a second set of substantially C-shaped support panels 32 is provided adjacent the first and second substantially C-shaped support panels 32 and spaced slightly therefrom. In this way, even greater support has been found to be provided.

A shoulder portion 18 is integrally knit to the upper torso portion 14 and includes straps 17 which extend over the wearer's shoulders to form arm openings 21. A neck opening 23 is located between the straps 17 and front and rear straps are connected by way of seams 19, which can be sewn or otherwise attached, proximate the top of the wearer's shoulder. Where desired, the brassiere 10 is completed by sewing or otherwise attaching banding 20 about the arm openings 21 and the neck opening 23. Alternatively, these portions could be hemmed or finished in a conventional manner.

Figure 3:
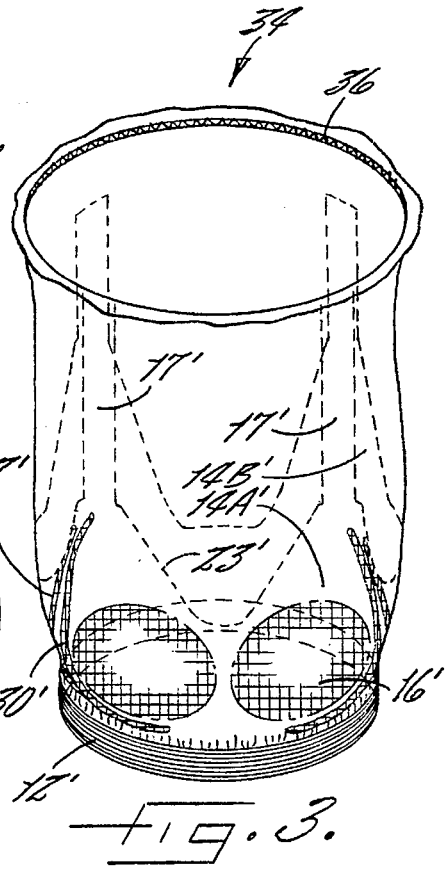
FIG. 3 is a perspective view of a blank according to the present invention.

FIG. 3 illustrates a blank 34 according the present invention. Like numbers are used to illustrate like elements from the completed brassiere of FIG. 1, with the elements of the blank being primed.

The blank 34 includes a cylindrical tubular fabric portion 12' in the form of a turned welt, which forms the torso encircling portion of the brassiere 10. An upper torso portion 14 which includes front and rear portions 14A' and 14B', respectively, is integrally knit to the cylindrical tubular fabric portion 12' This upper torso portion 14' includes differentially shaped breast cups 16' which preferably have knit-in fullness. In a preferred form of the invention, the breast cups 16' are defined by areas in which the courses are simple knit and have succeeding areas of courses varying between simple knit and welt knit courses. In a particularly preferred embodiment of the invention, yarns 22 forming courses 26 which form the upper torso portion 14 have an additional yarn or yarns 24 fed in in the regions of the breast cups 16' in order to form additional courses 28. These additional courses 28, as shown in FIG. 2, provide additional fabric in the breast cups 16', thereby providing knit-in cup fullness. Further, the fed-in yarns 24 can extend continuously across both breast cups thereby forming a plurality of yarns which float across the space between the two breast cups 16'. These yarns can provide additional support in the spacing between the breast cups 16', and enhance the delineation therebetween.

The blank also includes integrally knit support panels 30', 32', which have a greater resistance to stretch than the rest of the upper torso portion 14', particularly in a coursewise direction. The support panels 30', 32', are formed by modifying the knit stitch, such as by tucking or holding one or more stitches for a number of courses. It is particularly preferred to hold or tuck the stitch for four or more courses.

A shoulder portion 18' is knit to the upper torso portion 14' and the blank is then finished by knitting a series of courses in the form of a non-raveling edge 36.

To form a brassiere 10 from the blank 34, the blank is cut along cutting lines 32 to define arm openings, straps 17', and a neck opening. The straps 17' are then joined together along a seam 19 by sewing or other conventional means of attachment. Preferably, banding 20 is then attached around the arm openings 21, and the neck opening 23, to complete the brassiere.

In the drawings and specification there has been set forth a preferred embodiment of the invention, and although specific terms are employed, they are used in a generic and descriptive sense only and not for purposes of limitation, the scope of the invention being defined in the claims.

What is claimed is:

1. A method of making a circular knit blank comprising:

knitting a series of courses defining a cylindrical, tubular fabric portion in the form of a turned welt;

knitting to said turned welt a series of courses defining a tubular fabric upper torso portion, said upper torso portion including at least first and second discrete integrally knit generally walewise extending support panels having a greater resistance to coursewise stretch than the remainder of the upper torso portion to provide support for a wearer's breasts, said support panels being separated by first and second differentially shaped breast cups; and knitting to said upper torso portion a series of courses defining a shoulder portion including plural elongated areas in which the courses are simple knit with the areas being divided by elongate panel areas, and then completing the blank by knitting several courses forming a non-raveling edge.

2. The method according to claim 1, wherein said step of knitting an upper torso portion having first and second differentially shaped breast cups includes knitting two areas in which the fabric is in plain knit courses, the two areas being separated one from another.

3. The method according to claim 2, wherein said step of knitting an upper torso portion having first and second differentially shaped breast cups includes knitting an area between the two areas in which the fabric is in plain knit courses using alternating simple and welt knit courses.

4. The method according to claim 1, wherein said step of knitting an upper torso portion having first and second differentially shaped breast cups includes feeding in and knitting courses from yarns additional to those used in the remainder of the upper torso portion, thereby forming discrete regions having a greater number of courses.

5. The method according to claim 1, wherein said step of knitting an upper torso portion having at least first and second discrete integrally knit support panels having a greater resistance to coursewise stretch than the remainder of the upper torso portion comprises tucking specific stitches for a predetermined number of courses.

6. The method according to claim 1, wherein said step of knitting an upper torso portion having at least first and second discrete integrally knit support panels having a greater resistance to coursewise stretch than the remainder of the upper torso portion includes knitting a first substantially C-shaped support panel along an outer portion of each of said first and second differentially shaped breast cups and so that the support panel extends substantially perpendicular to said turned welt.

7. The method according to claim 6, wherein said step of knitting an upper torso portion having at least first and second discrete integrally knit support panels having a greater resistance to coursewise stretch than the remainder of the upper torso portion includes knitting a second substantially C-shaped support panel parallel and adjacent to each of said first substantially C-shaped support panels.

8. The method according to claim 1, wherein said step of knitting an upper torso portion having at least first and second discrete integrally knit support panels having a greater resistance to coursewise stretch than the remainder of the upper torso portion comprises knitting discrete regions having a modified knit structure from that of the remainder of the upper torso portion, to thereby form the support panels.

9. A circular knit blank for the manufacture of a brassiere comprising:

a cylindrical tubular fabric torso encircling portion in the form of a turned welt;

an upper torso portion comprising a series of courses knit to said turned welt and defining a tubular fabric portion having a pair of breast cups on a front portion thereof and including first and second discrete generally walewise extending support panels being separated by said breast cups and having a greater resistance to coursewise stretch than the remainder of the upper torso portion;

a shoulder portion comprising a series of courses knit to said upper torso portion and defining plural elongated areas in which the courses are simple knit, each of which is separated from the other by an elongate panel area; and a plurality of courses knit to said shoulder portion and forming a non-raveling edge.

10. The circular knit blank according to claim 9, wherein said first and second differentially shaped breast cups include areas in which the fabric is in plain knit courses, with the areas being separated one from another.

11. The circular knit blank according to claim 9, wherein said first and second differentially shaped breast cups are separated from each other by gathered panels comprising alternating simple and welt knit courses.

12. The circular knit blank according to claim 9, wherein said first and second differentially shaped breast cups include at least one fed-in yarn forming extra courses therein.

13. The circular knit blank according to claim 9, wherein said support panels include alternating courses of tuck and plain knit courses.

14. The circular knit blank according to claim 9, wherein said support panels are substantially C-shaped and a support panel is located adjacent an outer side of each of said breast cups, remote from the other of said breast cups.

15. The circular knit blank according to claim 14, further comprising two substantially C-shaped support panels located adjacent an outer side of each of said breast cups, remote from the other of said breast cups.

16. A method of making a brassiere comprising the steps of:

knitting a series of courses defining a cylindrical tubular fabric torso encircling portion in the form of a turned welt, then knitting to the turned welt a series of courses defining a tubular fabric upper torso portion, said upper torso portion including at least first and second discrete integrally knit generally walewise extending support panels having a greater resistance to coursewise stretch than the remainder of the upper torso portion, said support panels being separated by first and second differentially shaped breast cups; and knitting to said upper torso portion a series of courses defining a shoulder portion including plural elongated areas in which the courses are simple knit with the areas being divided by elongate panel areas, and knitting several courses forming a non-raveling edge, then cutting and removing from the upper torso and shoulder portions of the blank predetermined areas to define arm openings and a neck opening, and attaching together front and rear portions of the shoulder portion of the blank at opposite sides of the neck opening to form a completed brassiere.

17. A method according to claim 16, further comprising the step of attaching banding around the arm openings.

18. A method according to claim 16, further comprising the step of attaching banding around the neck opening.

19. A method according to claim 16, wherein said step of knitting an upper torso portion including at least first and second discrete integrally knit support panels having a greater resistance to coursewise stretch than the remainder of the upper torso portion comprises knitting discrete regions having a modified knit structure from that of the remainder of the upper torso portion, to thereby form the support panels.

20. The method according to claim 16, wherein said step of knitting an upper torso portion having first and second differentially shaped breast cups includes feeding in and knitting courses from yarns additional to those used in the remainder of the upper torso portion, thereby forming discrete regions having a greater number of courses.

21. The method according to claim 16, wherein said step of knitting an upper torso portion having at least first and second discrete integrally knit support panels having a greater resistance to coursewise stretch than the remainder of the upper torso portion includes knitting a first substantially C-shaped support panel along an outer portion of each of said first and second differentially shaped breast cups and substantially perpendicular to said turned welt.

22. A brassiere made from a circularly knit tubular fabric comprising:

a cylindrical tubular fabric torso encircling portion in the form of a turned welt;

an upper torso portion knit to the turned welt and including at least first and second discrete integrally knit generally walewise extending support panels having a greater resistance to coursewise stretch than the remainder of the upper torso portion and spaced from each other by a pair of differentially shaped breast cups; and first and second pairs of shoulder portions integrally knit with said upper torso portion, said shoulder strap portions being joined together to form shoulder straps.

23. The brassiere according to claim 22, wherein said differentially shaped breast cups include areas in which the fabric is in plain knit courses, with the areas being separated one from another.

24. The brassiere according to claim 22, wherein said differentially shaped breast cups are separated from each other by gathered panels comprising alternating simple and welt knit courses.

25. The brassiere according to claim 22, wherein said first and second differentially shaped breast cups include at least one fed-in yarn forming extra courses therein.

26. The brassiere according to claim 22, wherein said support panels include alternating courses of tuck and plain knit courses.

27. The brassiere according to claim 22, wherein said support panels are substantially C-shaped and a support panel is located adjacent an outer side of each of said breast cups, remote from the other of said breast cups.

28. The circular knit blank according to claim 27, further comprising two substantially C-shaped support panels located adjacent an outer side of each of said breast cups, remote from the other of said breast cups.

* * * * *